US012096864B1

(12) United States Patent
Shi

(10) Patent No.: US 12,096,864 B1
(45) Date of Patent: Sep. 24, 2024

(54) LEARNING-TO-SIT CHAIR

(71) Applicant: Dongguan Hongyu Plastic Co., Ltd., Guangdong (CN)

(72) Inventor: Juying Shi, Guangdong (CN)

(73) Assignee: Dongguan Hongyu PLastic Co., Ltd., Guangdong (CN)

( * ) Notice: Subject to any disclaimer, the term of this patent is extended or adjusted under 35 U.S.C. 154(b) by 0 days.

(21) Appl. No.: 18/598,076

(22) Filed: Mar. 7, 2024

(30) Foreign Application Priority Data

Nov. 29, 2023 (CN) ..... 202323247768.2

(51) Int. Cl.
*A47C 1/02* (2006.01)
*A47D 1/00* (2006.01)

(52) U.S. Cl.
CPC ..... *A47D 1/002* (2013.01)

(58) Field of Classification Search
CPC ..... A47C 4/54; A47C 15/006; A47D 15/005; A47D 3/001
USPC ..... 297/452.41
See application file for complete search history.

(56) References Cited

U.S. PATENT DOCUMENTS 4,601,667 A * 7/1986 Hull ..... A47C 4/54 297/DIG. 3
4,687,452 A * 8/1987 Hull ..... B63B 34/565 297/250.1
5,570,480 A * 11/1996 Yeung ..... B63B 34/52 441/130
6,971,936 B2 * 12/2005 Le Gette ..... A47C 15/006 441/130
D742,653 S * 11/2015 Thorn ..... D6/333
10,905,255 B1 * 2/2021 Miale ..... B60N 2/914

OTHER PUBLICATIONS

National Standards of the People's Republic of China; "Determination of the friction coefficient of the plastic film and sheet"; Mar. 9, 2021; 26 pages.

* cited by examiner

*Primary Examiner* — Shin H Kim
(74) *Attorney, Agent, or Firm* — Cooper Legal Group, LLC

(57) ABSTRACT

Disclosed in the present application is a learning-to-sit chair, including a base, a backrest structure and a limit structure, in which the backrest structure, the limit structure are symmetrically mounted at a top of the base, a cushion recess is defined in a center of the base, the backrest structure is arranged around the edge of the cushion recess, a legrest portion is protrudently disposed on a side of the base away from the backrest structure, and the limit structure is mounted at a top of the legrest portion.

16 Claims, 6 Drawing Sheets

LEARNING-TO-SIT CHAIR

CROSS-REFERENCE TO RELATED APPLICATION

This application claims a priority and benefit of China patent application serial no. 202323247768.2, filed on Nov. 29, 2023. The entirety of China patent application serial no. 202323247768.2 is hereby incorporated by reference herein and made a part of this specification.

TECHNICAL FIELD

The present application relates to a technical field of auxiliary tool for learning to sit, and in particular, to a learning-to-sit chair.

BACKGROUND ART

An infant usually learns sitting from 4th or 5th month, which can facilitate physical developments such as motor development and lumbar muscle development, being beneficial for development of infants. A learning-to-sit chair will need to be used when the infant is learning to sit, which can be classified into different categories according to different surface materials, for example, plastic air cushion chair, foam material chair, leather chair, and plush fabric chair, etc. In particular, the foam material chair, the leather chair and the plush fabric chair are highly absorbent, which tends to lead to water accumulation and difficult drying thoroughly when absorbing a large amount of water. Therefore, they are not suitable to assist bathing of children or infants. The plastic air cushion chair is formed by inflating, which can be inflated and deflated at any time, achieving adjustment of volume and size and convenient storage and transportation, and thus is widely used. A plastic surface is not absorbent and easy to be dried thoroughly, therefore it can be used to assist children or infants in bathing.

Generally, the plastic air cushion chairs for learning to sit includes a base, a backrest and a handrest. It will be bulged after inflation, so as to have a smooth surface. However, when children or infants are splashing and frolicking on the chair, they can be easily slid down or fall off the learning-to-sit chair due to unsteady sitting, thereby affecting the use safety of the plastic air cushion learning-to-sit chair.

SUMMARY

In order to reduce the possibility of sliding and falling of a child and an infant when sitting on a learning-to-sit chair and improve the safety of the learning-to-sit chair, the present application provides a learning-to-sit chair as follows:

a learning-to-sit chair, including a base, a backrest structure and a limit structure, wherein the backrest structure is positioned opposite and space apart from the limit structure at a top of the base, a cushion recess is defined on a center of the base, the backrest structure is arranged along a portion of an edge of the cushion recess, a legrest portion is convexly disposed at a side of the base away from the backrest structure, and the limit structure is mounted at a top of the legrest portion.

Providing of the cushion recess facilitates receiving the buttock of a child or an infant in the cushion recess when sitting on the learning-to-sit chair, playing a role of position limiting. Further, it facilitates attaching the back of the child or the infant contact to the backrest structure, so that they are subjected to a downward and backward force, to reduce a possibility of sliding down or falling off when the child or the infant is splashing and frolicking on the learning-to-sit chair.

The base of the existing learning-to-sit chair is of circular or square shape. When the infant is sitting the learning-to-sit chair, since legs of the infant are shorter, two legs of the infant are horizontally placed on a surface of the base while sitting on the learning-to-sit chair, therefore, when the infant is splashing and frolicking, it is easy to fall off the learning-to-sit chair due to movement.

Therefore, by providing of the legrest portion, distance between the limit structure and the backrest structure is increased, such that the learning-to-sit chair can be used for the child or the infant. When the infant is sitting on the chair, two legs of the infant can be hung over an outer wall of the cushion, and inner sides of a knee portion and a shank of the infant is attached to the legrest portion, so as to be subjected to a downward g-force, reducing the possibility of falling off or sliding down from the learning-to-sit chair when the infant is splashing and frolicking on the learning-to-sit chair, and improving safety of the learning-to-sit chair.

In summary, when the infant or the child sits on the learning-to-sit chair, their buttocks can be accommodated in the cushion recess. Two legs are kept apart by the limit structure, the knee portion of the infant or the child contact the legrest portion, thereby reducing the possibility of sliding down or falling off the learning-to-sit chair when the infant is splashing and frolicking on the learning-to-sit chair, and improving the safety of the chair.

Optionally, both of the base and the backrest structure are inflatable structures.

Optionally, at least one airhole is defined in a bottom of the base corresponding to the cushion recess.

The airhole plays a role of ventilation, reducing possibility of generating swelter on the buttock due to sultry caused by a long time of sitting. In addition, when the learning-to-sit chair is used for the bathing of an infant, water can be avoided from being accumulated at a bottom of the cushion recess, improving comfort of the learning-to-sit chair.

Optionally, At least one anti-slipping groove is defined in both of an inner side and an outer side of the backrest structure, and the anti-slipping groove is arranged along a length direction of the backrest structure.

Due to the providing of the anti-slipping groove, bulging on the backrest structure can be reduced, and a friction force between the backrest structure and the back of children or infants can be increased, which reduces the possibility of falling off or sliding down the learning-to-sit chair when the infant is splashing and frolicking on the learning-to-sit chair.

When a plurality of anti-slipping grooves are provided, an anti-slipping ridge is formed between two adjacent anti-slipping grooves, a wave-shaped curve is formed between the anti-slipping ridge and the anti-slipping groove.

In the above technical solution, anti-slipping action of the backrest structure further can be improved, reducing the possibility of sliding when the infant is splashing and frolicking.

Optionally, the limit structure is a cylindrical inflatable structure, a top of the limit structure is provided with a first inflation valve, the limit structure is inflated by the first inflation valve, a top of the legrest portion is provided with a second inflation valve, and the base is inflated by the second inflation valve.

By the providing of the first inflation valve, it is easy for the limit structure to inflate. A method for inflating can be achieved by pressing. By the providing of the second inflation valve, the air inside the limit structure can enter the base to achieve inflation. This can control the inflation amount of the learning-to-sit cushion, avoiding excessive inflation on the surface to form protrusions, which otherwise would lead to too smooth surface of the learning-to-sit chair and increase the possibility of sliding down when the infant is splashing and frolicking.

Optionally, the backrest structure is provided with a third inflation valve, and the backrest structure is inflated by the third inflation valve.

By the third inflation valve, the air inside the cushion is flowed into the backrest structure, inflating the backrest structure.

Any of the first inflation valve, the second inflation valve and the third inflation valve of the present application is unidirectional inflation valve, which is also called as inflation valve of an air cushion or an air nozzle.

Optionally, the learning-to-sit chair further includes a head protection structure, and a side of the backrest structure away from the base is connected to a bottom of the head protection structure.

By the head protection structure, head of the child or the infant can be further protected, further improving safety of the learning-to-sit chair, when the child or the infant leans back, the head can be attached to the head protection structure, further improving comfort of the learning-to-sit chair.

Optionally, the head protection is an inflatable structure, and a ventilation hole for communicating with the head protection structure is defined in the backrest structure.

By the providing of the ventilation hole, air inside the backrest structure is transported to the head protection structure, achieving inflating.

Optionally, A recess wall of the cushion recess and a top of the base are transited by an arc-shaped surface, forming ergonomics structures conformal with a buttock of a human body, therefore it is more comfortable when the infant sits on the learning-to-sit chair, meanwhile used for the child or the infant with each stage of age.

Optionally, appearance of the base is a shape of waterdrop. The surface of the legrest portion is inclined, a side of the legrest portion close to the backrest structure is higher than a side of the legrest portion away from the backrest structure.

Through the above configuration, it is convenient for the inner side of knee joint and the shank of the infant to contact the outer side edge of the legrest portion, such that two legs are hung over and subjected to a downward force, therefore, when the infant is splashing and frolicking, the possibility of falling off or sliding down can be reduced, improving safety of the learning-to-sit chair.

Optionally, the backrest structure is provided with a deflation value.

The deflation value is convenient for the learning-to-sit chair to deflate and store.

Optionally, a bottom of the base is detachably mounted with an auxiliary member, the auxiliary member is an anti-slipping silicone rubber sheet.

Optionally, the base includes a base piece, a connection piece and a top piece, the base piece and the top piece are connected to the connection piece, which are inflated to form the base. A cushion portion is provided on the center of the base piece and the top piece, the cushion portion of the base piece is attached to that of the top piece, at least one hole is arranged on each of the cushion portion, and two holes of the cushion portion are communicated with each other.

The above technical solution, compared with a single piece integrally-formed chair, has the following advantages. Firstly, both of a bottom and a top of the cushion are provided with a cushion portion, which forms two cushion recesses after inflation. Atop cushion recess is used for accommodating a buttock, and a bottom cushion recess can further be used to reduce bulge on the bottom of the base, while reducing contact area of the base and ground, increasing contact friction between the base and ground, and reducing a sliding of the bottom of the base.

In addition, an anti-slipping silicone rubber sheet is attached to edges of the cushion recess in the bottom of the base, playing an anti-slipping role. Since silicone rubber has adhesion and adsorption capacity, and can be attached and adhered to a bottom surface of the base, it can play a role of fixing the learning-to-sit chair, thereby achieving the anti-slipping action. The anti-slipping silicone rubber sheet is directly detached when the chair is not in use.

Optionally, the backrest structure includes a lower waist protection piece, a waist protection cushion and an upper waist protection piece, the lower waist protection piece is connected to a bottom of the waist protection cushion, the upper waist protection piece is connected to a top of the waist protection cushion, and the backrest structure is assembled.

Optionally, all of the base, the limit structure and the backrest structure are provided with an anti-slipping layer, or all of the backrest structure, the legrest portion, and an inner wall of the cushion recess, are provided with an anti-slipping layer.

By the anti-slipping layer, increasing friction between the base and ground, and increasing contact friction between body and the cushion, thereby reducing the possibility of sliding down and falling off when the child or the infant is sitting on the learning-to-sit chair.

Optionally, thickness of the anti-slipping layer is 0.01-0.1 mm.

The anti-slipping layer with the above thickness range can increase the contact frictions between the learning-to-sit chair, body and ground, reducing sliding down and falling off of the child or the infant, further reducing the possibility of sliding down and falling off due to a lower height of the learning-to-sit chair.

Optionally, the anti-slipping layer is an anti-slipping coating.

Optionally, the anti-slipping coating includes the following components in parts by weight:

| | |
|---|---|
| aqueous epoxy acrylates | 46-63 parts; |
| anti-slipping filler | 18-25 parts; |
| aqueous curing agent | 3-5 parts; and |
| water | 7-33 parts. |

In the above raw materials, a type of the aqueous epoxy acrylates in the present application can be YG-EE640, available from Xiamen Continent Chemical Co., LTD, a viscosity at 25° C. can be 1000-3000 mPa·s, which has more environmental friendliness and adhesion. After combining to the anti-slipping filler, under auxiliary action of the water and the aqueous curing agent, anti-slipping coating formed by curing is stably connected to the learning-to-sit chair. The anti-slipping filler has the effects of anti-slipping and skin friendliness, further improving performances of anti-slipping and skin friendliness for the learning-to-sit chair.

The aqueous curing agent can be PT-1405A, available from Guangzhou Green Protection New Materials Co., Ltd.

Optionally, the anti-slipping filler has a particle size of 50-80 m.

The above anti-slipping filler is selected to have a better anti-slipping effect on the ground and the body, while also having a effect of skin friendliness, so as to reduce a damage to the skins of the infant or the child due to excessive friction.

Optionally, the anti-slipping filler includes the following components in parts by weight:

| | |
|---|---|
| anti-slipping filler with particle size of 50-100 nm | 5-10 parts; |
| anti-slipping filler with particle size of 1-20 μm | 12-18 parts; and |
| anti-slipping filler with particle size of 50-80 μm | 25-35 parts. |

By selecting the above particle range, a better effect of anti-slipping and skin friendliness of the anti-slipping coating can be obtained.

Optionally, the anti-slipping filler includes the following components in parts by weight:

| | |
|---|---|
| D,L-polylactide | 2-5 parts; |
| ethylene methacrylate glyceride copolymer | 5-10 parts; |
| silicone resin | 8-15 parts; |
| biobased polyurethane | 3-8 parts; and |
| fiber powder | 10-20 parts. |

The components and weight range of the above raw materials are best selected in the present application, in which, silicone resin can be a vinyl MQ silicone resin having the following advantages: powdered form, more than 99% of solid content, average molecular weight of 10000-30000, and better adhesion, softness, toughness, and so on. When the silicon resin is used for anti-slipping filler, it can improve properties such as wearing quality, flexibility and skin friendliness of the anti-slipping filler.

Ethylene methacrylate glyceride copolymer can be BF-7L, available from Sumitom company, Japan, having some characteristics such as up to 8% GMA content, average molecular weight of 3000-5000, excellent compatibility, adhesion, etc. It can further improve compatibility of the anti-slipping filler, so that anti-slipping coating has good skin friendliness and anti-slipping performance.

D,L-polylactide is a novel biodegradable material, which is made of starch recovered from renewable plant resources such as corn, therefore having advantages such as biodegradability, antibacterial properties, adhesion and mechanical strength, etc., as well as a viscosity-average molecular weight of preferably 60000-100000. The biobased polyurethane further has biodegradable property, while having elasticity, softness, and wear resistance. Combining the biobased polyurethane with the D,L-polylactide is beneficial for improving effects of wear resistant, anti-slipping and antibacterial activity, and, after being further combined with the ethylene methacrylate glyceride copolymer and the vinyl MQ silicone resin, provides a good skin-friendliness feeling and a certain stickiness to human skin.

In addition, adding the fiber powder further reduces viscosity of the anti-slipping filler, while improves flexibility and skin friendliness, and prevents excessive stickiness to hands. When the anti-slipping filler is used for anti-slipping and skin-friendliness coating material, the anti-slipping coating has a good skin friendliness and anti-slipping performance.

Optionally, the anti-slipping filler is prepared by the following methods:

weighing and mixing 2-5 weight parts of D,L-polylactide, 5-10 weight parts of ethylene methacrylate glyceride copolymer, 8-15 weight parts of silicone resin, 3-8 weight parts of biobased polyurethane, and 10-20 weight parts of fiber powder, uniformly; heating to 120-130° C., stirring for 10-30 min at a stirring speed of 100-300 r/min; heating to 150-160° C., stirring for 10-30 min, cooling to room temperature, grinding and sieving to obtain the anti-slipping filler with particle size of 50-100 nm, the anti-slipping filler with particle size of 1-20 m and the anti-slipping filler with particle size of 50-80 m, respectively.

The above preparation method is easy to operate. Mixing all of the raw materials and heating to 120-130° C. can melt the raw materials preliminarily. Then, heating to 150-160° C. can further melt and mixing the raw materials evenly, improving a compatibility of components of the raw materials, to obtain an anti-slipping filler having good skin-friendliness and anti-slipping performance.

Optionally, the fiber powder includes one or a combination of more components selected from a group consisting of chitosan fiber powder, seaweed fiber powder, soy protein composite fiber and milk protein fiber powder.

Chitosan fiber powder is made of chitosan having a good softness, antibacterial activity and skin friendliness, available from Weifang Yingke Marine Biomaterials Co., Ltd, and a particle is 2D.

Seaweed fiber powder, also known as seaweed charcoal fiber, is a fiber processed by which ultrafine particle formed by crushing carbonization of seaweed charcoal is blended with solutions such as polyester solution or nylon solution, etc., and spun, which is usually used in cloth, having properties such as biodegradability, flexibility, antibacterial activity. It can preferably be seaweed fiber powder with particle size of 2D, available from Qingdao Gecheng Jingwei Biotechnology Co., Ltd.

Soy protein composite fiber powder is obtained by crushing soy protein composite fiber made by blending soy protein with polyvinyl alcohol (PVA) to form a spinning solution, which is wet spun. The content of soybean protein is 60-70%. It has effects of good softness and high strength.

Milk protein fiber powder is obtained by crushing milk protein fiber powder having effects such as soft texture, moisture absorption, moisture conductivity, good strength, and good extensibility.

Therefore, the present application provides a fiber powder consisting of one or more of the chitosan fiber powder, the seaweed fiber powder, the soy protein composite fiber and the milk protein fiber powder, which has the advantages of softness, skin friendliness, antibacterial activity, etc. Therefore, the composited anti-slipping filler can be used as anti-slipping and skin friendliness coating, and the anti-slipping coating has a good effects of skin friendliness, antibiosis and anti-slipping performance, etc.

Optionally, the fiber powder is a composition of the chitosan fiber powder, the seaweed fiber powder, the soy protein composite fiber and the milk protein fiber powder in a weight ratio of 1:(0.3-0.8):(0.1-0.3):(1.5-2.8); or a composition of the soy protein composite fiber, the milk protein fiber powder, the chitosan fiber powder and the seaweed fiber powder in a weight ratio of 1:(0.8-1.7):(0.1-0.5):(1-3).

When the chitosan fiber powder, the seaweed fiber powder, the soy protein composite fiber, and the milk protein fiber powder are used together, they can have a synergistic effect, thereby achieving better skin friendliness and anti-slipping performance of the anti-slipping coating.

In summary, the present application can achieve at least one of the following beneficial technical effects:

By the providing of the cushion recess, it is convenient for buttock of the child or the infant to be accommodated in the cushion recess while using the learning-to-sit chair, achieving the action of limit, the back of the child or the infant is attached to the backrest structure, subjecting to a downward and backward force. By the providing of the legrest portion, distance between the limit structure and the backrest structure is increased, the learning-to-sit chair can be suitable for children or infants. Meanwhile when the infant is using the chair, two legs of the infant can be hung over outer wall of the cushion, and inner sides of a knee portion and a shank of the infant contact the legrest portion, which is affected by g-force; when the infant or the child using the learning-to-sit chair, buttocks of which are accommodated in the cushion recess, and two legs are kept apart by the limit structure, knee portions of infants or children are abutted against the legrest portion, thereby reducing the possibility of falling off from the learning-to-sit chair when infants are splashing and frolicking on the learning-to-sit chair, and improving the safety of the infant chair. When the infant or the child sits on the learning-to-sit chair, their buttocks can be accommodated in the cushion recess. Two legs are kept apart by the limit structure, the knee portion of the infant or the child contact the legrest portion, thereby reducing possibility of falling off or sliding down from the learning-to-sit chair when the infant is splashing and frolicking on the learning-to-sit chair, and improving the safety of the chair.

DETAILED DESCRIPTION

The present application is further described in detail below in combination with FIGS. 1-6.

Embodiment 1

Figure 1:
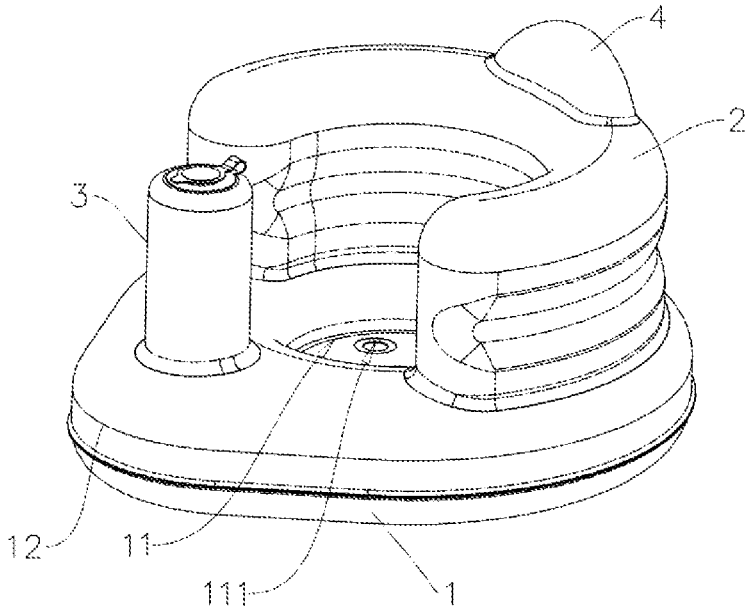
FIG. 1 is a schematic structure diagram of a learning-to-sit chair according to Embodiment 1.
Figure 2:
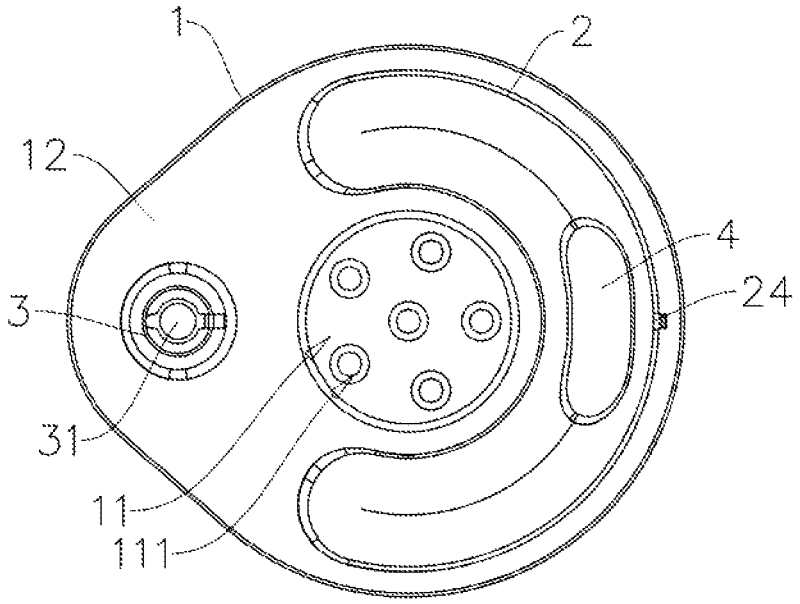
FIG. 2 is a top view of the learning-to-sit chair according to Embodiment 1.

The present application discloses a learning-to-sit chair. Referring to FIG. 1 and FIG. 2, it includes a base 1, a backrest structure 2, a limit structure 3 and a head protection structure 4, all of the base 1, the backrest structure 2, the limit structure 3 and the head protection structure 4 are integrally-formed air cushion structures. A cushion recess 11 is defined in a center of a top surface of the base 1, and a bottom surface of the backrest structure 2 is fixed to an edge of the base 1 close to the cushion recess 11. A recess wall of the cushion recess 11 and a top surface of the base 1 are transited by an arc-shaped surface, forming ergonomics structures conformal with a buttock of a human body. At least one airhole 111 is defined in the base 1 corresponding to the cushion recess 11, and a number of the airholes 111 can be 1, 2, 3, 4, 5, etc., preferably 4 in the present embodiment. The airhole 111 can not only play a role of ventilation, but also avoid reducing use comfort due to water accumulated in the cushion recess 11 when a child or an infant is bathing.

A side of the base 1 away from the backrest structure 2 is convexly provided with a legrest portion 12, the limit structure 3 is mounted at a top of the legrest portion 12, so that an overall appearance of the base 1 assumes a shape of water drop. Further, a surface size of the legrest portion 12 is gradually increased from a side close to the backrest structure 2, and the legrest portion 12 and the backrest structure 2 are symmetrically arranged about an axis. Due to the providing of the above legrest portion 12, when an infant sits on the learning-to-sit chair, an inner side of a knee portion on two legs and a shank of the infant contact an outer side edge of the legrest portion 12, so that two legs are hung over the learning-to-sit chair, and subjected to a downward g-force, which renders it difficult for the infant to fall off or slide down, improving safety of the learning-to-sit chair.

The limit structure 3 is preferably a cylindrical inflatable structure, a top of the limit structure 3 is provided with a first inflation valve 31, the limit structure 3 is inflated by the first inflation valve 31, a top of the base 1 corresponding the legrest portion 12 is provided with a second inflation valve 13, and the base 1 is inflated by the second inflation valve 13. Each of the first inflation valve 31 and the second inflation valve 13 is a unidirectional switch value, so that the learning-to-sit chair can be inflated by pressing an inflatable limit column; and air inside the limit structure 3 can enter the base 1 through the first inflation valve 31.

At least one anti-slipping groove 21 is defined in both of inner side and outer side of the backrest structure 2, and arranged along a length direction of the backrest structure 2. When a plurality of anti-slipping grooves 21 are provided, an anti-slipping ridge is formed between two adjacent anti-slipping grooves 21, and a wave-shaped curve is formed between the anti-slipping ridge and the anti-slipping groove 21. Due to the providing of the anti-slipping groove 21, backs of children or infants can be attached on the backrest structure 2, and a friction force between the backrest structure 2 and the back of children or infants can be increased, which reduces the possibility of falling off or sliding down the learning-to-sit chair when the infant is splashing and frolicking on the learning-to-sit chair.

A third inflation valve 22 in air communication with the base 1 is mounted on a bottom of the backrest structure 2, which realizes inflation of the backrest structure 2 when air inside the base 1 flows into the third inflation valve 22 during inflating. In addition, the backrest structure 2 is mounted with a deflation value 24, which is configured for the learning-to-sit chair to deflate.

Atop of the backrest structure 2 is connected to a bottom of the head protection structure 4, and an air vent 23 for communicating with the head protection structure 4 is defined in the backrest structure 2. When inflating, the air inside the backrest structure 2 flows into the inner space of the head protection structure 4.

All of the first inflation valve 31, the second inflation valve 13 and the third inflation valve 22 are unidirectional inflation valves which facilitate inflating. The connections of the base 1 and the limit structure 3, the base 1 and the backrest structure 2, the backrest structure 2 and the head protection structure 4 can be achieved by adhesive glue, or by heating, so as to achieve heat lamination. Either of the above connections can provide a more stable learning-to-sit chair, and improve safety of the learning-to-sit chair.

Implementing principle of a learning-to-sit chair in embodiment 1 of the present application is as follows.

The base 1, the limit structure 3, the head protection structure 4 and the backrest structure 2 are integrally formed, respectively. A cushion recess 11 is defined in a center of the base 1; and a top of the limit structure 3 is mounted with a first inflation valve 31 for realizing inflation by air entering the limit structure 3 when being pressed. The legrest portion 12 on the base 1 is mounted with a second inflation valve 13, then the backrest structure 2 is fixed to the legrest portion 12 by a glue, in such a way that the second inflation valve 13 is aligned with an inner cavity of the limit structure 3, and the backrest structure 2 is fixed to the edge of the cushion recess 11, so that a central axis of the backrest structure 2 is arranged symmetrically relative to a central axis of the limit structure 3. By providing the air vent 23, the head protection structure 4 is adhered to the top of the limit structure 3 by glue. Then the deflation value 24 is mounted to obtain the learning-to-sit chair.

Embodiment 2

Figure 3:
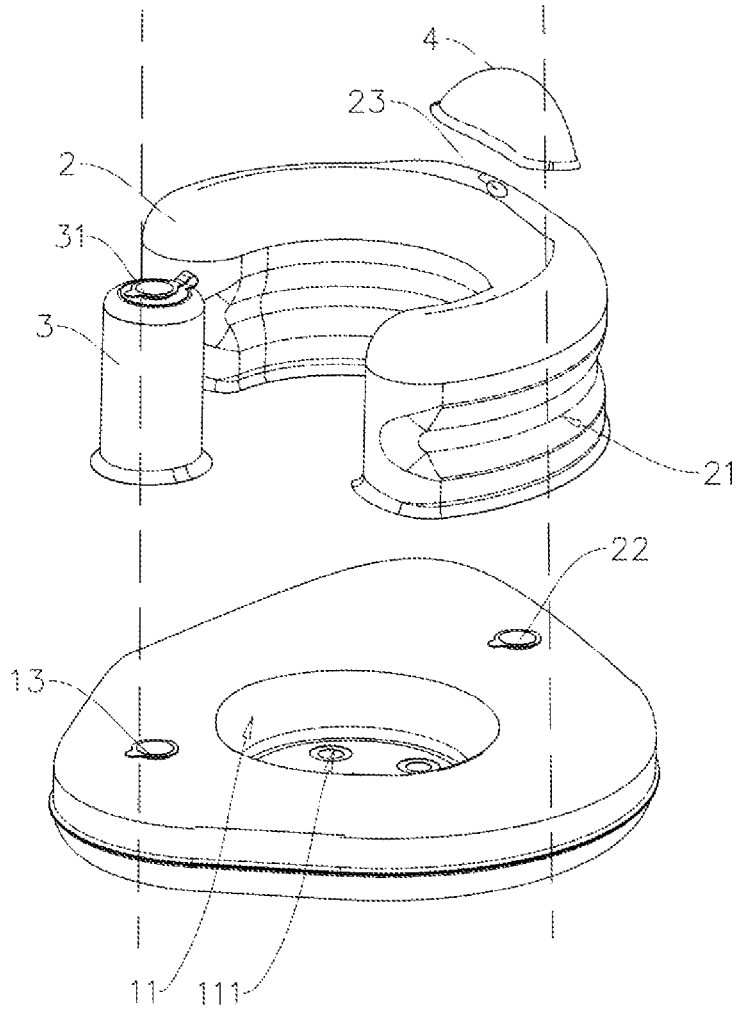
FIG. 3 is a partial exploded view of the learning-to-sit chair according to Embodiment 1.
Figure 4:
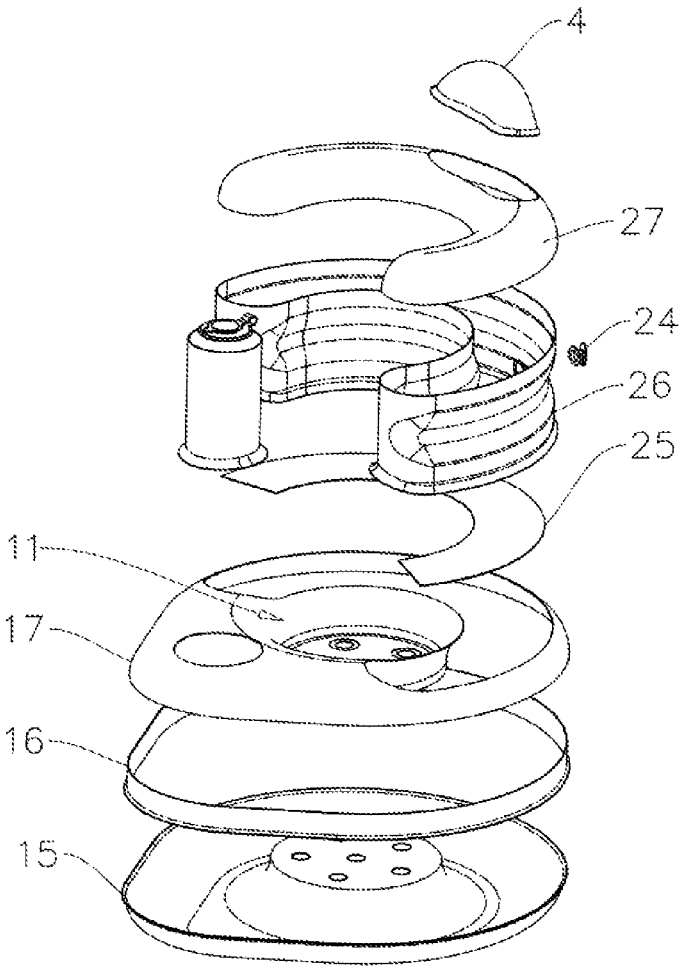
FIG. 4 is an exploded view of a learning-to-sit chair according to Embodiment 2.

Embodiment 2 differs from Embodiment 1 as follows. Referring to FIG. 3, the base 1 includes a base piece 15, a connection piece 16 and a top piece 17. The base piece 15 is connected to the top piece 17 by heat lamination via the connection piece 16, which are inflated to form the base 1. A cushion portion is provided on a center of the base piece 15 and the top piece 17. During the process of connecting by heat lamination, the centers of the base piece 15 and the top piece 17 are adhered together. After inflation, a cushion recess 11 is formed in both of the bottom and top of the base 1, and at least one holes is defined in the bottom of the base 1 corresponding to the cushion recess 11, by which two cushion recesses communicate with each other. A number of holes is one, four, five, six, or ten, preferably four holes in the present embodiment.

The backrest structure 2 includes a lower waist protection piece 25, a waist protection cushion 26 and an upper waist protection piece 27. The lower waist protection piece 25 is connected to a bottom of the waist protection cushion 26 by glue, and the upper waist protection piece 27 is connected to the waist protection cushion 26 by glue, thereby being assembled to form the backrest structure 2. Other structures are the same as embodiment 1.

Implementing principle of embodiment 2 is as follows. the base piece 15, the top piece 17 and the connection piece 16 are connected by heat fusing to form the base 1. The anti-slipping groove 21 is formed in the waist protection cushion 26 by heat-pressing, and the lower waist protection piece 25, the waist protection cushion 26 and the upper waist protection piece 27 are connected by heat fusing to form a waist protection structure, which is further connected and assembled with the head protection structure 4 and the limit structure 3 to obtain the final cushion recess 11. Other structures are the same as those in Embodiment 1.

Embodiment 3

Figure 5:
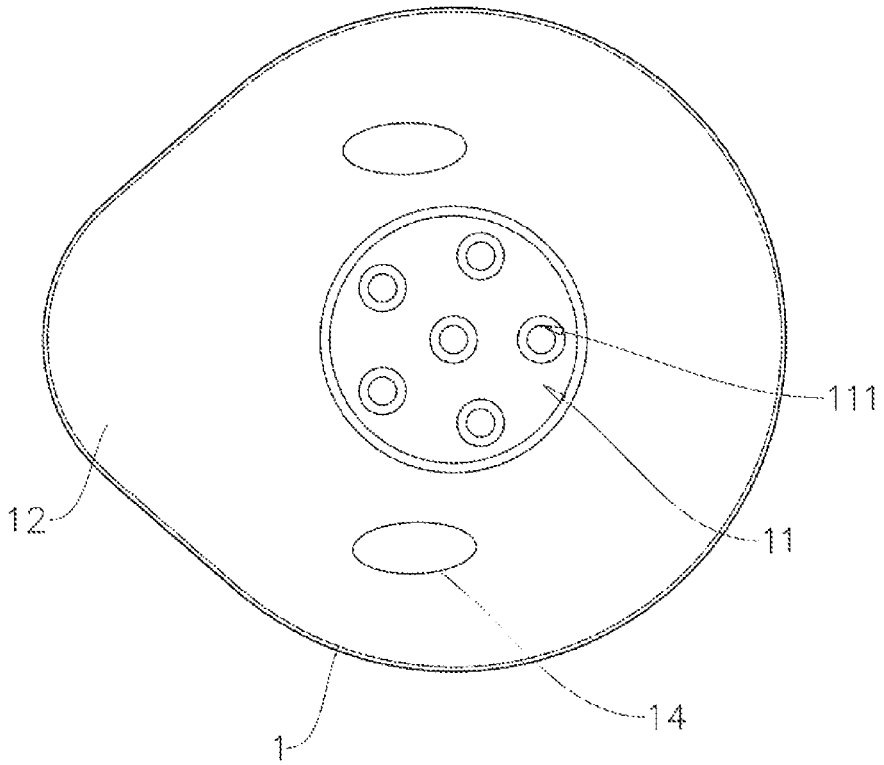
FIG. 5 is a structural view of a learning-to-sit chair according to Embodiment 3.

Embodiment 3 differs from embodiment 1 as follows. Referring to FIG. 5, the bottom of the base 1 is detachably mounted with an auxiliary member 14, which can be anti-slipping silicone rubber sheet having effects of anti-slipping and adhesion. The anti-slipping silicone rubber sheet is adhered to the bottom of the cushion, so that the auxiliary member 14 is adhered to the bottom of the base 1. When the anti-slipping silicone rubber sheet contacts the ground, the anti-slipping silicone rubber is adsorbed onto the ground, such that the learning-to-sit chair is fixed to the ground. For removing the chair, a large force is needed for separating the anti-slipping silicone rubber sheet from the ground, or separating the anti-slipping silicone rubber sheet from the bottom of the chair, which is beneficial to improving safety and convenience of the learning-to-sit chair.

Embodiment 4

Figure 6:
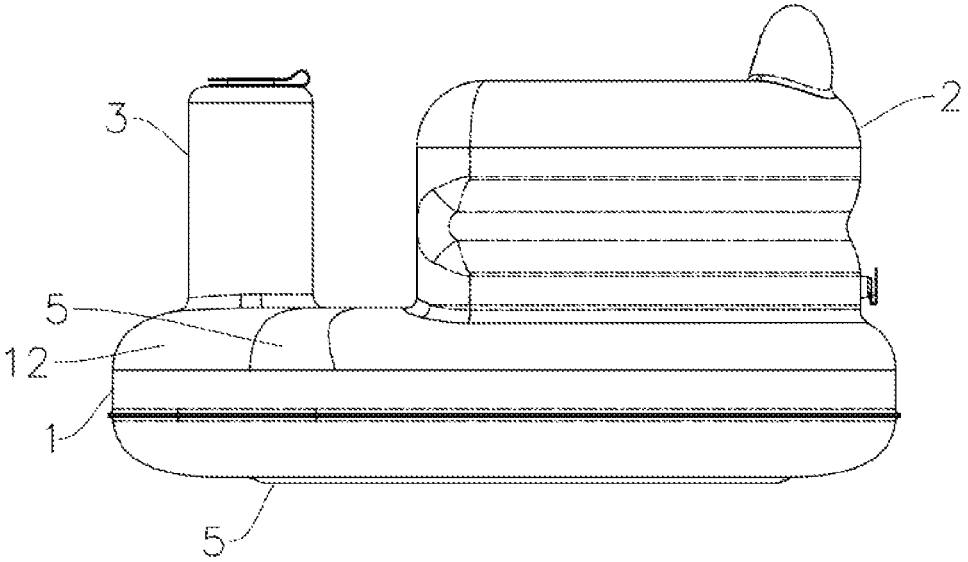
FIG. 6 is a structural view of the learning-to-sit chair according to Embodiment 4.

Embodiment 4 differs from Embodiment 1 as follows. Referring to FIG. 6, all of the outer surfaces of the base 1, the limit structure 3, and the backrest structure 2 are provided with an anti-slipping layer 5, or an inter wall of the cushion recess 11, the backrest structure 2, and the legrest portion 12 are provided with an anti-slipping layer 5. When using the infant chair, all of the area where the infant chair comes into contact with body are arranged with an anti-slipping layer 5. The present embodiment can be preferred an anti-slipping layer 5 arranged in areas that the infant chair comes into contact with body, which can play an anti-slipping role in the areas of contact, further can reduce waste of materials. Thickness of the anti-slipping layer 5 can be 0.01, 0.03, 0.05, 0.08, 0.1 mm, or the like, preferably 0.1 mm in the present embodiment.

Embodiment 5

Embodiment 5 differs from Embodiment 4 in that anti-slipping layer of 0.1 mm was used as an anti-slipping coating.

The anti-slipping coating was prepared by the following steps:

Weighing and mixing 4.6 kg of aqueous epoxy acrylates, 1.8 kg of anti-slipping filler, 0.3 kg of aqueous curing agent and 3.3 kg of water, stirring at a rotary speed of 150 r/min for 30 min to obtain a mixture; applying the mixture on outer surface of the base, the limit structure and the backrest structure, heating to 80° C., and curing for 1 min to obtain the anti-slipping coating.

In particular, the anti-slipping filler was obtained by the following methods:

Weighing 0.5 kg of anti-slipping filler with particle size of 50-100 nm, 1.2 kg of anti-slipping filler with particle size of 1-20 m and 2.5 kg of anti-slipping filler with particle size of 50-80 m, and mixing evenly to obtain the anti-slipping filler.

The anti-slipping filler was prepared by the following method:

Weighing 2 kg of D,L-polylactide, 5 kg of ethylene methacrylate glyceride copolymer, 8 kg of ethyl MQ silicone resin, 3 kg of biobased polyurethane and 10 kg of fiber powder, mixing evenly, heating to 120° C., stirring for 30 min at a rotary speed of 120 r/min, heating to 150° C., stirring for 10 min, cooling to room temperature, grinding and sieving to obtain anti-slipping filler with particle size of 50-100 nm, anti-slipping filler with particle size of 1-20 m and anti-slipping filler with particle size of 50-80 m, respectively.

The above fiber powder was seaweed fiber powder.

Embodiment 6

Embodiment 6 differs from Embodiment 5 in that, the raw materials of the anti-slipping coating includes 5.4 kg of aqueous epoxy acrylates, 2.2 kg of anti-slipping filler, 0.4 kg of aqueous curing agent and 2 kg of water.

The anti-slipping filler was prepared by the following method:

Weighing 0.8 kg of anti-slipping filler with particle size of 50-100 nm, 1.5 kg of anti-slipping filler with particle size of 1-20 m and 3.0 kg of anti-slipping filler with particle size of 50-80 m, and mixing evenly to obtain the anti-slipping filler.

Embodiment 7

Embodiment 7 differs from Embodiment 5 in that the raw materials of the anti-slipping coating includes 6.3 kg of aqueous epoxy acrylates, 2.5 kg of anti-slipping filler, 0.5 kg of aqueous curing agent and 0.7 kg of water.

The anti-slipping filler was prepared by the following methods:

Weighing 1 kg of anti-slipping filler with particle size of 50-100 nm, 1.8 kg of anti-slipping filler with particle size of 1-20 m and 3.5 kg of anti-slipping filler with particle size of 50-80 m, mixing evenly to obtain the anti-slipping filler.

Embodiment 8

Embodiment 8 differs from Embodiment 6 in including 3 kg of D,L-polylactide, 8 kg of ethylene methacrylate glyceride copolymer, 12 kg of silicone resin, 5 kg of biobased polyurethane and 15 kg of fiber powder.

Embodiment 9

Embodiment 9 differs from Embodiment 6 in including 5 kg of D,L-polylactide, 10 kg of ethylene methacrylate glyceride copolymer, 15 kg of silicone resin, 8 kg of biobased polyurethane and 20 kg of fiber powder.

Embodiment 10

Embodiment 10 differs from Embodiment 8 in that, the fiber powder was prepared by mixing the chitosan fiber powder, the seaweed fiber powder, the soy protein composite fiber and the milk protein fiber powder in a weight ratio (kg) of 1:0.3:0.2:2.2 evenly, grinding and sieving through a mesh of 500.

Embodiment 11

Embodiment 11 differs from Embodiment 8 in that, the fiber powder is prepared by mixing the soy protein composite fiber, the milk protein fiber powder, the chitosan fiber powder and the seaweed fiber powder in a weight ratio (kg) of 1:1.3:0.4:2 evenly, grinding and sieving through a mesh of 500.

Embodiment 12

Embodiment 12 differs from Embodiment 5 in that the anti-slipping filler was an anti-slipping filler with particle size of 1-20 m.

Embodiment 13

Embodiment 13 differs from Embodiment 5 in that ethyl MQ silicon resin was replaced with an equal amount of biobased polyurethane.

Embodiment 14

Embodiment 14 differs from Embodiment 5 in that the fiber powder was replaced with an equal amount of silica.

Experiment and Analysis

Test of Anti-Slipping Effect

Test samples were formed by cutting the legrest portions of the infant chairs of Embodiment 1 and Embodiment 5 to 14, and tested by the following performance tests, in which, Embodiment 1 was used as a control group, and the specific steps were as follow.

Pendulum type friction coefficient measuring instrument was used for testing according to GB/T 10006. The principle was as follows. An upper end of the pendulum was mounted with a rubber slider of having specific hardness and elasticity. When being located at an unbalance position, the upper end of the pendulum will beat a surface of the tested samples at a constant speed, and a coefficient of friction is correspondingly obtained. In particular, liquid human-used silicone materials (available from Shenzhen Tianfuyang Technology Co., Ltd, a viscosity of 700 CPS at 25° C., having a soft touch close to human skin) were smeared on a surface of the rubber slider on the pendulum type friction coefficient measuring instrument. After being fully cured, film of 0.1 mm was formed on the surface of the rubber block, and a weight of the rubber slider with film was acquired and recorded as A1.

The test was performed for 30 times, in which frictional coefficient was obtained and averaged by testing for the first 10 times. Frictional coefficient of Embodiment 1 is recorded as B1, frictional coefficients of Embodiments 5 to 14 were recorded as B2, and anti-slipping rate=[(B2−B1)/B1] *100%. After performing test for 30 times, the rubber block was removed, and weight of the rubber block of Embodiment 1 and Embodiments 5 to 14 was weighed by using a thousandth scale, and recorded as A2, where mass loss=[(A1−A2)/A1] *100%. The particular data is shown in Table 1.

TABLE 1

Experiment data of Embodiment 1 and Embodiments 5 to 14
It can be seen from the above data that,
mass loss of Embodiment 5 is less than that of

| Test item | Mass loss (%) | Anti-slipping rate (%) |
|---|---|---|
| Embodiment 1 | 0.0011 | 0 |
| Embodiment 5 | 0.0124 | 369.8 |
| Embodiment 6 | 0.0105 | 374.7 |
| Embodiment 7 | 0.0129 | 398.7 |
| Embodiment 8 | 0.0089 | 388.5 |
| Embodiment 9 | 0.0096 | 386.9 |
| Embodiment 10 | 0.0058 | 407.4 |
| Embodiment 11 | 0.0062 | 411.25 |
| Embodiment 12 | 0.0093 | 219.8 |
| Embodiment 13 | 0.0456 | 258.75 |
| Embodiment 14 | 0.1687 | 422.3 |

Embodiment 13, and anti-slipping rate of Embodiment 5 is higher than that of Embodiment 13, indicating that anti-slipping filler prepared by the raw materials of the present application has a better effects of anti-slipping and skin friendliness.

Anti-slipping rate of Embodiment 5 is higher than that of Embodiment 12, indicating that filling with anti-slipping fillers with three kinds of particle size plays a better anti-slipping role.

Mass loss of Embodiment 5 is less than that of Embodiment 14, indicating that filing with the fiber powder of the present application has a better effect of skin friendliness.

The above are the preferred embodiments of the present application, which are not intended to limit the protection scope of the present application. Therefore, all equivalent changes made according to the structure, shape and principle of the present application should be covered within the protection scope of the present application.

What is claimed is:

1. A learning-to-sit chair, comprising: a base, a backrest structure and a limit structure, wherein the backrest structure is positioned opposite and space apart from the limit structure at a top of the base, a cushion recess is defined on a center of the base, the backrest structure is arranged along a portion of an edge of the cushion recess, a legrest portion is convexly disposed at a side of the base away from the backrest structure, and the limit structure is mounted at a top of the legrest portion, wherein all of the base, the limit structure and the backrest structure are provided with an anti-slipping layer, or all of the backrest structure, the legrest portion, and an inner wall of the cushion recess are provided with the anti-slipping layer, wherein the anti-slipping layer is an anti-slipping coating, and wherein the anti-slipping coating comprises the following components in parts by weight:

| | |
|---|---|
| aqueous epoxy acrylates | 46-63 parts; |
| anti-slipping filler | 18-25 parts; |
| aqueous curing agent | 3-5 parts; and |
| water | 7-33 parts. |

2. The learning-to-sit chair according to claim 1, wherein at least one airhole is defined in a bottom of the base corresponding to the cushion recess.

3. The learning-to-sit chair according to claim 1, wherein at least one anti-slipping groove is defined in both of an inner side and an outer side of the backrest structure, and the at least one anti-slipping groove is arranged along a length direction of the backrest structure.

4. The learning-to-sit chair according to claim 1, wherein the limit structure is a cylindrical inflatable structure, a top of the limit structure is provided with a first inflation valve, the limit structure is inflated by the first inflation valve, the top of the legrest portion is provided with a second inflation valve, and the base is inflated by the second inflation valve.

5. The learning-to-sit chair according to claim 1, wherein the backrest structure is provided with a third inflation valve, and the backrest structure is inflated by the third inflation valve.

6. The learning-to-sit chair according to claim 1, further comprising a head protection structure, and a side of the backrest structure away from the base is connected to a bottom of the head protection structure.

7. The learning-to-sit chair according to claim 6, wherein the head protection structure is an inflatable structure, and a ventilation hole for communicating with the head protection structure is defined in the backrest structure.

8. The learning-to-sit chair according to claim 1, wherein the backrest structure is provided with a deflating valve.

9. The learning-to-sit chair according to claim 1, wherein a bottom of the base is detachably mounted with an auxiliary member.

10. The learning-to-sit chair according to claim 9, wherein the auxiliary member is an anti-slipping silicone rubber sheet.

11. The learning-to-sit chair according to claim 1, wherein the anti-slipping filler comprises the following components in parts by weight:

| | |
|---|---|
| anti-slipping filler with particle size of 50-100 nm | 5-10 parts; |
| anti-slipping filler with particle size of 1-20 μm | 12-18 parts; and |
| anti-slipping filler with particle size of 50-80 μm | 25-35 parts. |

12. The learning-to-sit chair according to claim 11, wherein the anti-slipping filler comprises the following components in parts by weight:

| | |
|---|---|
| D,L-polylactide | 2-5 parts; |
| ethylene methacrylate glyceride copolymer | 5-10 parts; |
| silicone resin | 8-15 parts; |
| biobased polyurethane | 3-8 parts; and |
| fiber powder | 10-20 parts. |

13. The learning-to-sit chair according to claim 12, wherein the fiber powder comprises one or a combination of more components selected from a group consisting of chitosan fiber powder, seaweed fiber powder, soy protein composite fiber and milk protein fiber powder.

14. The learning-to-sit chair according to claim 13, wherein the fiber powder is a composition of the chitosan fiber powder, the seaweed fiber powder, the soy protein composite fiber and the milk protein fiber powder in a weight ratio of 1:(0.3-0.8):(0.1-0.3):(1.5-2.8).

15. The learning-to-sit chair according to claim 13, wherein the fiber powder is a composition of the soy protein composite fiber, the milk protein fiber powder, the chitosan fiber powder and the seaweed fiber powder in a weight ratio of 1:(0.8-1.7):(0.1-0.5):(1-3).

16. The learning-to-sit chair according to claim 12, wherein the anti-slipping filler is prepared by the following method:

weighing and mixing 2-5 weight parts of the D,L-polylactide, 5-10 weight parts of the ethylene methacrylate glyceride copolymer, 8-15 weight parts of the silicone resin, 3-8 weight parts of the biobased polyurethane and 10-20 weight parts of the fiber powder uniformly, heating to 120-130° C., stirring for 10-30 min at a stirring speed of 100-300 r/min, heating to 150-160° C., stirring for 10-30 min, cooling to room temperature, grinding and sieving to obtain the anti-slipping filler with particle size of 50-100 nm, the anti-slipping filler with particle size of 1-20 μm and the anti-slipping filler with particle size of 50-80 μm, respectively.

* * * * *